US010894428B2

(12) United States Patent
Tsukada et al.

(10) Patent No.: US 10,894,428 B2
(45) Date of Patent: Jan. 19, 2021

(54) IMAGE PROCESSING DEVICE, COCKLING DETECTION METHOD, MACHINE LEARNING SYSTEM

(71) Applicant: SEIKO EPSON CORPORATION, Tokyo (JP)

(72) Inventors: Kazunari Tsukada, Matsumoto (JP); Tetsuo Tatsuda, Ina (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/421,613

(22) Filed: May 24, 2019

(65) Prior Publication Data

US 2019/0358968 A1 Nov. 28, 2019

(30) Foreign Application Priority Data

May 28, 2018 (JP) ..... 2018-101247

(51) Int. Cl.

| | |
|---|---|
| ***B41J 11/00*** | (2006.01) |
| ***G03G 15/04*** | (2006.01) |
| ***B41J 11/20*** | (2006.01) |
| ***B41J 2/21*** | (2006.01) |

(52) U.S. Cl.

CPC ..... *B41J 11/0005* (2013.01); *B41J 2/2117* (2013.01); *B41J 11/20* (2013.01); *G03G 15/04036* (2013.01)

(58) Field of Classification Search

CPC ..... B41J 11/0005; B41J 11/20; B41J 2/2117; B41J 11/0095; G03G 15/04036; G03G 15/5029; H04N 5/2253

See application file for complete search history.

(56) References Cited

U.S. PATENT DOCUMENTS 5,521,692 A * 5/1996 Bares ..... G01B 11/306 347/221

FOREIGN PATENT DOCUMENTS

JP 2009-119713 A 6/2009

* cited by examiner

*Primary Examiner* — Scott A Richmond
(74) *Attorney, Agent, or Firm* — Workman Nydegger

(57) ABSTRACT

Provided is technology enabling detecting cockling in a print medium without printing a cockling detection pattern on the print medium. An image processing device has: a light source configured to illuminate a print medium; a sensor configured to scan the print medium; and a controller configured to control the light source and sensor. The controller determines if there is cockling in an evaluation area of the print medium based on change in the detection values of the sensor in the evaluation area.

10 Claims, 13 Drawing Sheets

IMAGE PROCESSING DEVICE, COCKLING DETECTION METHOD, MACHINE LEARNING SYSTEM

BACKGROUND

1. Technical Field

The present invention relates to an image processing device, a cockling detection method, and a machine learning system.

This application is based upon Japanese Patent Application 2018-101247 filed on May 28, 2018, the entire contents of which are incorporated by reference herein.

2. Related Art

Printers having a cockling detection function for detecting wrinkling of the print medium are known from the literature. JP-A-2009-119713, for example, describes technology for printing a cockling detection pattern on the print medium, detecting the reflection from the print medium of light emitted by an LED with a phototransistor, and detecting the distance between the phototransistor and the print medium (the height of wrinkles from cockling) based on the output of the phototransistor.

This method of the related art requires at least two processes, first printing a cockling detection pattern at a place on the print medium where cockling easily occurs, and then scanning the cockling detection pattern that was printed at that location.

SUMMARY

The present invention provides technology enabling detecting cockling without printing a cockling detection pattern on the print medium.

An image processing device according to the invention includes a light source configured to illuminate a print medium; a sensor configured to scan the print medium; and a controller configured to control the light source and sensor. The controller determines if there is cockling in an evaluation area of the print medium based on change in the detection values of the sensor in the evaluation area.

More specifically, the sensor scans an evaluation area of the print medium illuminated by the light source; and the controller determines if cockling is present based on change in the detection values of the sensor in the evaluation area of the print medium. If there is cockling in the evaluation area, shadows (differences in brightness) are produced. The controller can detect the appearance of shadows from change in the detection values of the sensor. When a shadow is detected, the controller determines there is cockling in the evaluation area, and when there are no shadows, determines there is no cockling in the evaluation area.

To detect shadows caused by cockling, there is no need for a cockling detection pattern to be printed in the evaluation area of the print medium. The invention therefore enables determining whether or not there is cockling without printing a detection pattern on the print medium.

In an aspect of the invention, the detection value of the sensor are either gradation values read by the sensor, or reflectivity acquired by converting the gradation values, and change in the detection values of the sensor is change from the detection values expected when there is no cockling on the print medium.

This configuration enables determining there is cockling when the detection values of the sensor have changed compared with the detection values of the sensor expected when a print medium with no cockling is scanned.

In another aspect of the invention, the minimum limit of a specific range including a detection value used as a white reference of the print medium is used as a threshold; and the controller determines there is cockling when the detection value of the sensor is less than or equal to the threshold.

More specifically, the range of detection values expected when there is no cockling on the print medium is the specific range including the detection value used as the white reference, and the minimum limit of this specific range is the threshold. If the detection value from the sensor is less than or equal to this threshold, the controller determines the detection value is darker than the specific range, that is, determines there is a shadow, and determines there is cockling.

In another aspect of the invention, the detection value used as a white reference of the print medium is a detection value read by the sensor from an area of the print medium that is unprinted and has no cockling.

This configuration enables accurately acquiring the detection value used as the white reference. As a result, the presence of cockling can be accurately determined based on the detection value used as the white reference.

In another aspect of the invention, the detection value used as a white reference of the print medium is a detection value acquired by the sensor when multiple light sources are on.

Compared with a configuration in which the sensor scans with a single light source on, this configuration enables acquiring detection values used as the white reference of the print medium under conditions that are not easily affected by uneven lighting or fine surface texturing of the print medium.

In another aspect of the invention, the controller determines there is cockling when change in the detection value of the sensor in the evaluation area is abrupt and greater than a reference.

It can be determined that there is a shadow in the print medium when the detection value at a first position in the evaluation area, and the detection value at a second position in the evaluation area, are different, that is, when one is darker than the other. In this configuration, the presence of cockling can be determined according to the degree of positional change in the detection values in the evaluation area.

In another aspect of the invention, the controller determines there is cockling when the detection value of the sensor in the evaluation area drops from a first range to a second range, and then returns to the first range.

This configuration enables there is cockling of peaks or valleys in the evaluation area when there is a dark area between one bright area and another bright area in the evaluation area.

In another aspect of the invention, the controller controls the sensor to scan the print medium when one light source is on.

By illuminating the print medium from one direction, shadows can be easily produced when there is cockling. By the sensor scanning the print medium in this condition, cockling can be more easily detected.

An image processing device according to another aspect of the invention has N (where N is an integer of two or more) light sources configured to illuminate the evaluation area from mutually different positions; and the controller causes N light sources or fewer of the N light sources to emit one at a time while the sensor scans the print medium, and determines if cockling is present.

More specifically, the sensor in this configuration scans the print medium when at least two of the N light sources are controlled to emit one by one, and the controller determines whether or not there is cockling based on the scanning results (sensor detection values) in each state of illumination. This configuration enables detecting cockling with wrinkles travelling in different directions.

Note that all of the N light sources are not necessarily used to detect cockling.

An image processing device according to another aspect of the invention has at least two of the multiple light sources disposed to opposing positions.

This configuration suppresses the effects of uneven lighting and fine texturing in the print medium when acquiring the detection value used as the white reference.

In an image processing device according to another aspect of the invention, the controller determines if cockling is present in each of multiple evaluation areas in a main scanning direction of the print medium.

This configuration enables evaluating cockling in multiple areas along the main scanning direction of the print medium. The chance of failing to detect cockling can therefore be reduced.

Another aspect of the invention is a cockling detection method including: acquiring a detection value of a sensor that scans a print medium illuminated by a light source; and determining if there is cockling in an evaluation area based on change in a sensor detection value in the evaluation area of the print medium.

This method enables detecting if there is a shadow in the evaluation area based on change in the detection values of the sensor. When a shadow is produced, this method determines there is cockling in the evaluation area, and when there are a shadow is not produced, determines there is no cockling in the evaluation area.

To detect shadows caused by cockling, there is no need to print a cockling detection pattern in the evaluation area of the print medium. This method of the invention therefore enables determining whether or not there is cockling without printing a detection pattern on the print medium.

Another aspect of the invention is a machine learning system including: an acquirer configured to acquire multiple detection values of a sensor that scans a print medium illuminated by a light source; and a trainer configured to learn if there is cockling in a print medium based on a detection value of the sensor.

This aspect of the invention enables using a neural network model optimized by a machine learning system to determine if there is cockling in a print medium.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below in the following order with reference to the accompanying figures.

(1) Embodiment 1

(1-1) Printer configuration (1-2) Measuring a white reference and black reference (1-3) Cockling detection process (1-4) Evaluation examples (2) Other embodiments

(1) Embodiment 1

(1-1) Printer Configuration

Figure 1:
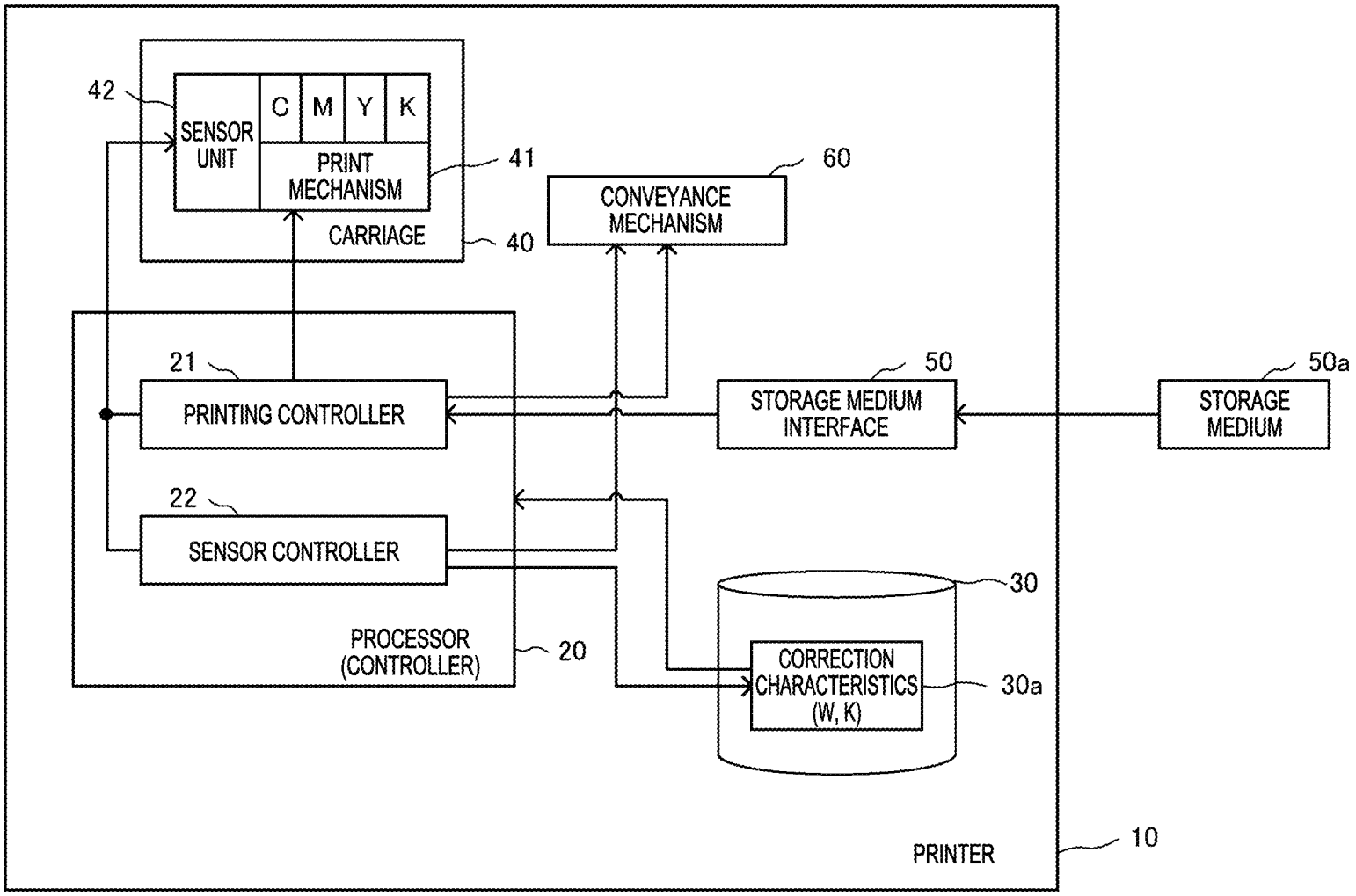
FIG. 1 is a block diagram of a printer according to a preferred embodiment of the invention.

FIG. 1 is a block diagram illustrating the configuration of a printer 10 that functions as an image processing device according to the first embodiment of the invention.

The printer 10 has a processor 20 (controller) including RAM and a CPU, and nonvolatile memory 30, and the processor 20 executes a printing control program and a sensor control program stored in the nonvolatile memory 30. The nonvolatile memory 30 can obviously be a different type of storage medium.

When the printing control program is run by the processor 20, the processor 20 functions as a printing controller 21. The processor 20 can control a print mechanism 41 and conveyance mechanism 60 through functions of the printing controller 21, and print images on a print medium. When the processor 20 runs the sensor control program, the processor 20 functions as a sensor controller 22. The processor 20 can control a sensor unit 42 and the conveyance mechanism 60 through functions of the sensor controller 22, and can scan the print medium.

The printer 10 in this embodiment of the invention is an inkjet printer. The printer 10 also has a carriage 40, a storage medium interface 50, and a conveyance mechanism 60. The storage medium interface 50 enables connecting a removable storage medium 50*a*, and the processor 20 can acquire image data and other data from the installed storage medium 50*a*. The processor 20 is obviously not limited to acquiring image data from the storage medium 50*a*, and may be configured to acquire image data in other ways, including by wired communication or wireless communication from a connected computer.

The conveyance mechanism 60 is a device that conveys the print medium in a specific direction. The processor 20 controls the conveyance mechanism 60 to convey the print medium by a specific process. Disposed to the carriage 40 are a print mechanism 41 and sensor unit 42. The processor 20 controls moving the carriage 40 bidirectionally on a specific axis. The printer 10 is configured so that the carriage 40 travels in a specific direction while a specific distance from the platen is maintained.

The print mechanism 41 includes a printhead capable of discharging four types of ink, specifically CMYK (C: cyan, M: magenta, Y: yellow, K: black) inks, and an ink tank that is installed to the printhead and holds the CMYK inks. The colors and numbers of inks in this embodiment is obviously only one example, and other colors of inks and other numbers of ink colors may be used. The printhead has multiple ejection nozzles arrayed in a direction perpendicular to the direction of carriage 40 movement, and the processor 20 can control the amount of ink discharged from each nozzle and the discharge timing.

Images can therefore be printed on the print medium by ejecting ink of the desired colors from the discharge nozzles while moving the carriage 40 in a specific direction. In addition, by repeatedly conveying the print medium by the conveyance mechanism 60 and while moving the carriage 40 and ejecting ink from the printhead, images can be printed at the desirable position in the printable area of the print medium. In this example, the direction in which the print medium is conveyed is referred to as the sub-scanning direction, and the direction in which the carriage 40 travels is referred to as the main scanning direction.

The sensor unit 42 functions to scan the print medium on the platen. In this embodiment of the invention, the sensor unit 42 is disposed to the carriage 40 adjacent to the printhead of the print mechanism 41 in the main scanning direction (adjacent to the carriage 40 on the opposite side as the home position (initial position)). The processor 20 can therefore move the sensor unit 42 in the main scanning direction by moving the carriage 40. In this embodiment, this configuration enables including the entire printable area of the print medium in the main scanning direction in the viewing range of the sensor unit 42 by moving the sensor unit 42, and reading the printed image at any position in the main scanning direction.

This configuration enables using the scanning results from the sensor unit 42 to detect cockling of the print medium. Because the distance between the ejection nozzles and the print medium is different when cockling, which is wrinkling of the print medium, occurs and when cockling does not occur, ink cannot be ejected at the ejection timing appropriate to the distance, and the print quality of the print mechanism 41 may drop. Therefore, before printing, this embodiment of the invention scans the print medium on the platen with the sensor unit 42, and based on the scanning result determines whether or not there is any cockling.

If cockling is detected, the processor 20 can create a state with no cockling of the print medium on the platen by controlling the conveyance mechanism 60 to repeatedly convey the print medium in the normal and reverse directions. If cockling is detected, the processor 20 can also report cockling to the user through a user interface not shown. This enables the user to repeat feeding the print medium so that the print medium is flat and cockling of the print medium on the platen does not occur. Print quality can therefore be improved by printing on the print medium when there is no cockling. In addition, if cockling occurs frequently at the same position, rollers, the platen, or other parts of the conveyance mechanism 60 can be adjusted or replaced.

Figure 2:
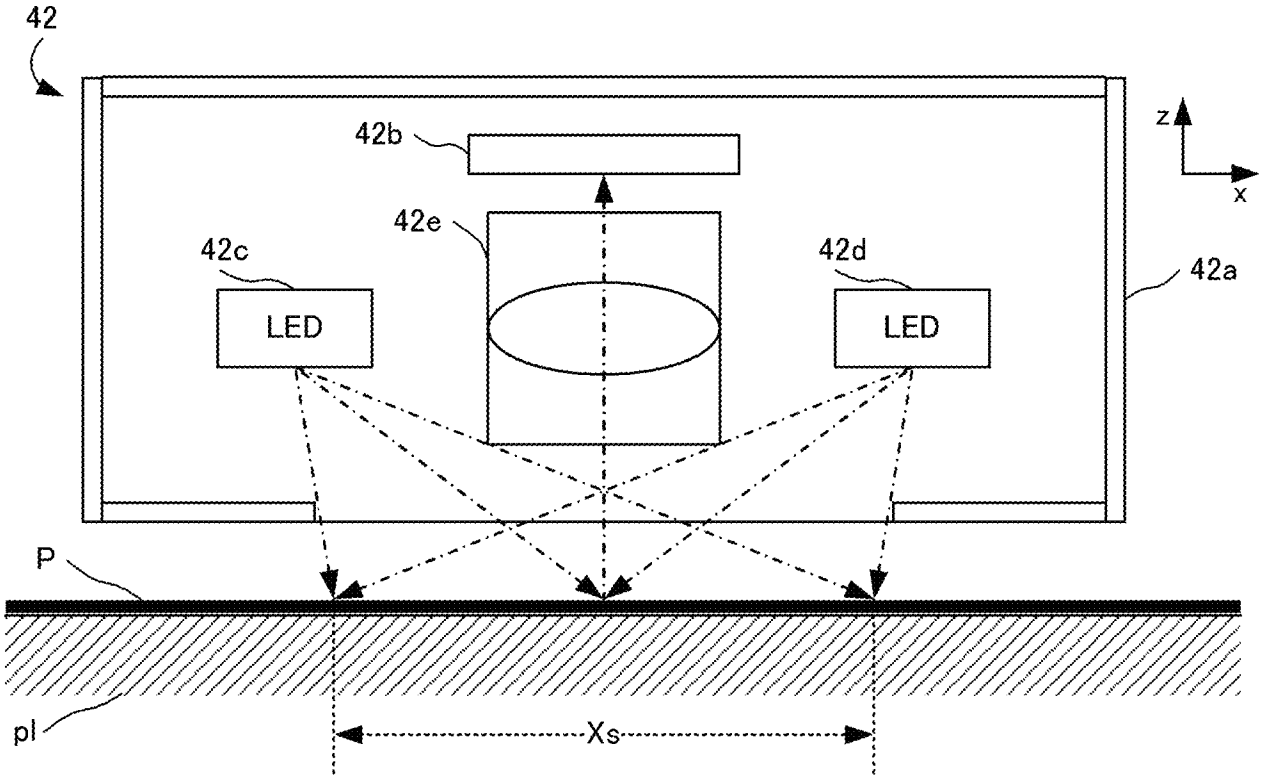
FIG. 2 illustrates the configuration of the sensor unit.

FIG. 2 illustrates the configuration of the sensor unit 42. Shown in FIG. 2 are the sensor unit 42, print medium P, and platen pl, with the main scanning direction indicated by the X-axis, and the direction perpendicular to the printing surface indicated by the Z-axis. The sub-scanning direction is the direction perpendicular to the X-axis and the Z-axis through the thickness of the drawing. Herein, the sub-scanning direction is referred to as the Y-axis.

As shown in FIG. 2, the sensor unit 42 in this example has a case 42*a*, the case 42*a* forming a space inside the sensor unit 42. Inside the case 42*a* are disposed an area image sensor 42*b*, LEDs 42*c* and 42*d*, and a lens 42*e*.

The area image sensor 42*b* comprises sensor elements in a two-dimensional array. The sensor elements detect the brightness of specific colors through RGB (R: red, G: green, B: blue) color filters.

The LEDs 42*c* and 42*d* are light sources that emit light to the print medium, and in this embodiment the sensor unit 42 illuminates the print medium by LEDs 42*c* and 42*d* at two locations. The two LEDs 42*c* and 42*d* are also disposed in this example at positions facing the evaluation area from opposite sides of a line parallel to the X-axis through the center of the area image sensor 42*b*. More specifically, the LEDs 42*c* and 42*d* are disposed along the X-axis at symmetrical positions parallel to the Z-axis through the center of the area image sensor 42*b*. The LEDs 42*c* and 42*d* are also disposed to illuminate the same area (evaluation area).

The lens 42*e* is disposed on the negative Z-axis side of the area image sensor 42*b*. Light emitted from the LEDs 42*c* and 42*d*, and reflected and scattered by the print medium P passes through the lens 42*e* and is focused on the sensor elements of the area image sensor 42*b*. The area image sensor 42*b* can therefore read an image of the print medium P illuminated by the LEDs 42*c* and 42*d*. Some of the paths of light emitted to the scanning area Xs of the print medium P, and the paths of light passing from the print medium P through the lens 42*e* to the area image sensor 42*b*, are indicated by the dot-dash lines in the example in FIG. 2.

The area image sensor 42*b* in this example is an area image sensor in which the scanning area Xs on the X-axis is shorter than the scanning area on the Y-axis, and can scan a substantially rectangular area (equivalent to the evaluation area).

More specifically, the scanning area Xs in this embodiment is 20 mm wide on the X-axis, and the scanning area on the Y-axis is 40 mm long. The shape and size of the area image sensor 42*b* described herein are simply examples, and other configurations, including an area image sensor 42*b* that is longer on the X-axis, may obviously be used.

The processor 20 can capture an image of the surface of the print medium P based on the brightness of the RGB colored lights read by the sensor elements of the area image sensor 42*b*. The processor 20 can also move the carriage 40 in the main scanning direction, and can acquire the position of the carriage 40 after the carriage 40 moves. The processor 20 can acquire the position of the carriage 40 in the main scanning direction after an image is read by the sensor unit 42 (that is, the position of the sensor unit 42 in the main scanning direction), and can correlate the location of the carriage 40 to the location of the sensor unit 42.

(1-2) Measuring a White Reference and Black Reference

This embodiment of the invention detects cockling based on the appearance of shadows (differences in brightness) produced by wrinkles in the print medium when the print medium is illuminated from one direction. As a result, before executing the cockling detection process described below, the printer 10 measures both a white reference and black reference from the print medium for which cockling is to be evaluated.

The black reference uses the detection value read when the LEDs 42*c* and 42*d* are off and light is not incident to the area image sensor 42*b*. When the user commands measuring the black reference, the processor 20 controls the sensor unit 42 to turn the LEDs 42*c* and 42*d* off. The processor 20 then acquires the black reference gradation value K based on the signals output by the area image sensor 42*b*. The area image sensor 42*b* is a sensor having sensor elements in a two-dimensional array. The black reference gradation value K is the average of the gradation values of the pixels in a scanning area of a specific length on the X-axis and Y-axis.

Note that a print medium having a black image patch of a specific density printed throughout the entire scanning area (evaluation area) of the sensor unit 42 may be used to acquire the black reference. The black image patch may be any image that appears black as a result of ink printed at a specific density throughout the scanning area of the sensor unit 42, or a black image patch printed with the maximum density of black (K) ink (the maximum amount of ink that can be printed on the print medium). A configuration that acquires gradation value K based on the output result of the area image sensor 42*b* when the area image sensor 42*b* reads a black image patch when the LEDs 42*c* and 42*d* are off may also be used.

To measure the white reference, an unprinted (blank) area where ink has not been printed anywhere in the scanning area (evaluation area) of the sensor unit 42 is reserved on the print medium. When the user sets an unprinted print medium in the printer 10 and commands measuring the white reference, the processor 20 controls the conveyance mechanism 60 and carriage 40 through functions of the sensor controller 22 to position this white space (where the area of no printing on the print medium is the white reference) to the scanning position of the sensor unit 42. More specifically, the processor 20 controls the carriage 40 to move the sensor unit 42 to a position enabling scanning the white space. The conveyance mechanism 60 also conveys the print medium so that the white space is in the scanning area of the sensor unit 42.

After conveying the print medium, the processor 20 measures the white reference by a function of the sensor controller 22. More specifically, the processor 20 controls the sensor unit 42 to turn LED 42*c* and LED 42*d* on. Based on the output signal from the area image sensor 42*b*, the processor 20 then acquires the white reference gradation value w.

The white reference gradation value w is the average of the gradation values of the pixels in a scanning area of a specific length on the X-axis and Y-axis. The processor 20 also moves the carriage 40 (or moves the print medium) so that a different white space on the print medium is at the scanning position of the sensor unit 42, and with the LED 42*c* and LED 42*d* on, acquires the white reference gradation value w based on the signals output by the area image sensor 42*b*. More specifically, the processor 20 acquires the white reference gradation value w based on multiple unprinted areas on the print medium.

The processor 20 then calculates the average of the multiple white reference gradation values w as the white reference gradation value W. By using the average gradation values acquired from multiple unprinted areas as the white reference gradation value W, the effect of cockling in part of the multiple scanning areas on the white reference gradation value W can be reduced, and the effect of differences in gradation values dependent on the location in the print medium can be reduced.

The detection values used as the white reference of the print medium in this embodiment of the invention are the detection values from the sensors when two opposing light sources (LEDs 42*c* and 42*d*) are both on. As a result, compared with configurations in which the sensors scan the print medium while only a single light source is on, and configurations in which the sensors scan the print medium with multiple adjacent light sources that are not in opposition and illuminate the print medium from substantially the same direction, the configuration of the invention can acquire detection values representing the white reference of the print medium in a state substantially free of the effects of uneven lighting and minute unevenness in the surface of the print medium.

Note that the white reference may also be measured by the user feeding an unprinted print medium again so that the print medium is flat and cockling of the print medium on the platen does not occur. This enables acquiring a detection value used as the white reference of the print medium by scanning an area of the print medium that has not been printed on and is free of cockling. An accurate value can therefore be acquired as the detection value used as the white reference.

Note that if a previously acquired white reference gradation value W (and black reference gradation value K) for a particular type of print medium is stored in nonvolatile memory 30 (or is published on a server not shown and can be downloaded to nonvolatile memory 30 at any time), there is no need to measure the white reference and black reference when printing, and this measurement step can be omitted. For example, the white reference and black reference may be measured when the print medium is replaced or when the printhead, light source, or other component on the carriage 40 is replaced.

The processor 20 stores the gradation value W indicating the white reference and the gradation value K indicating the black reference that are acquired by the measurements described above as correction characteristics 30*a* in the nonvolatile memory 30. In this example, the gradation values output from the sensor unit 42 are adjusted using the reflectivity of the acquired white reference as 100% and the reflectivity of the acquired black reference as 0%.

More specifically in this example, the white reference gradation value W is related to white gradation level Rw, and the black reference gradation value K is related to black gradation level Rk.

Note that in this embodiment the sensor unit 42 outputs gradation levels as 16-bit values (ranging from (0-65535), where the white gradation level Rw is 45056, and the black gradation level Rk is 4096, for example. The gradation values S output from the sensor unit 42 are corrected to gradation values R according to equation (1) below.

$$R=\{(S-K)/(W-K)\}\times(Rw-Rk)+Rk \quad (1)$$

Next, reflectivity r is calculated according to equation (2) below based on the gradation value R calculated from equation (1).

$$r=\{(R-Rk)/(Rw-Rk)\}\times 100 \quad (2)$$

Note that reflectivity r can also be calculated by substituting equation (2) in equation (1) as shown in equation (3) below.

$$r=\{(S-K)/(W-K)\}\times 100 \quad (3)$$

The cockling detection process converts the gradation values S output from the sensor unit 42 in the evaluation area to reflectivity r, and determines there is cockling if the reflectivity r is different from the white reference detection value (the reflectivity of the white reference in this embodiment) expected when there is no cockling of the print medium.

(1-3) Cockling Detection Process

Figure 3:
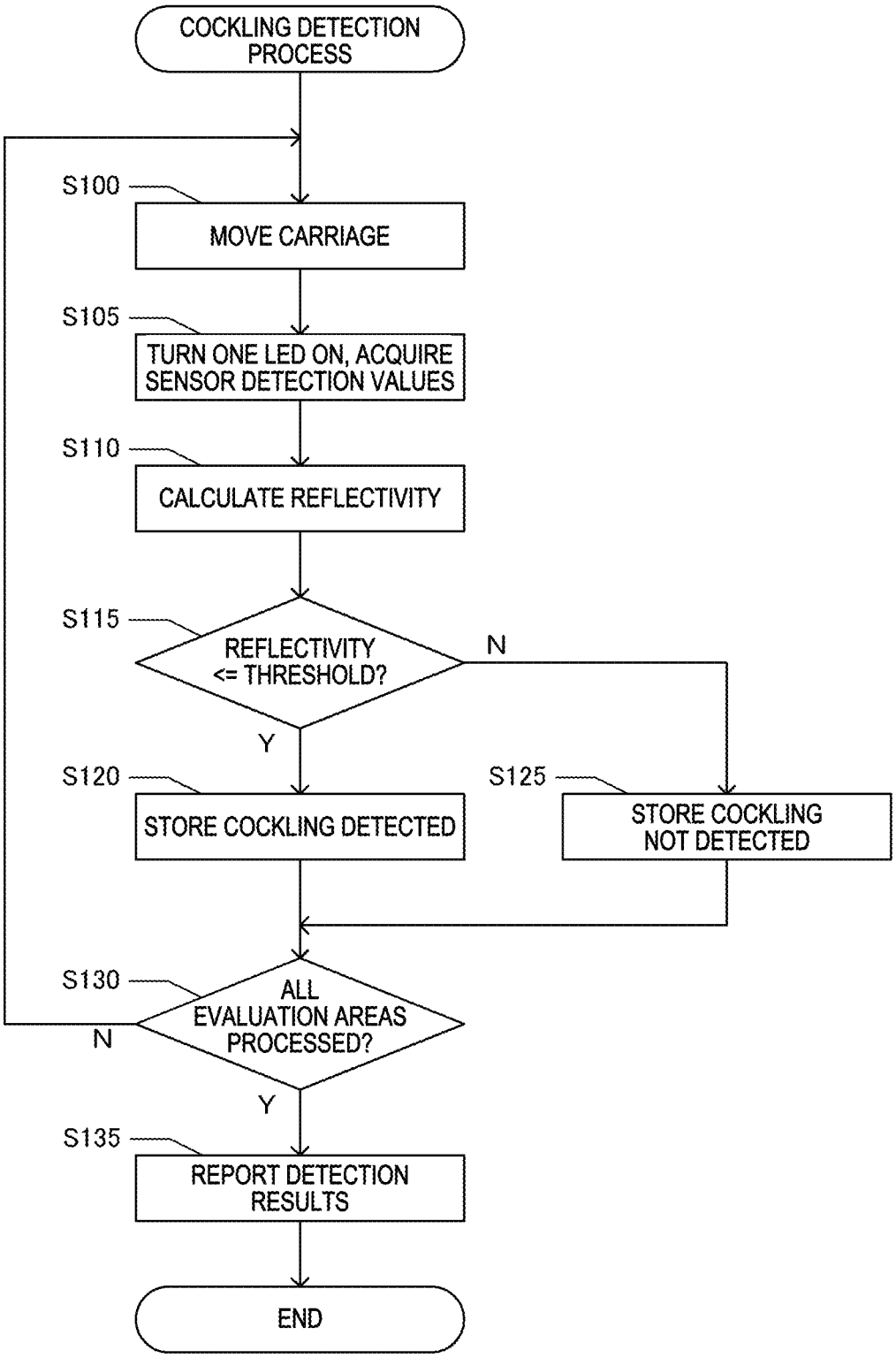
FIG. 3 is a flow chart of the cockling detection process.

FIG. 3 is a flow chart of the cockling detection process. This embodiment of the invention supposes the printer 10, which in this example is a large format printer, prints on roll paper as the print medium P. The cockling detection process is executed by the processor 20 before starting to print and after the roll paper is set in the roll holder and paper conveyance is controlled to position an unprinted area of the print medium P in the scanning range of the area image sensor 42*b*. Note that measuring the white reference and black reference of the print medium P as described above are completed before the cockling detection process starts.

When the cockling detection process starts, the processor 20 moves the carriage 40 (step S100). More specifically, the processor 20 moves the carriage 40 so that the evaluation area of the print medium P is positioned to enable scanning by the sensor unit 42.

Multiple evaluation areas are set in the main scanning direction of the print medium P, and in step S100 the carriage 40 is moved so that one of the evaluation areas can be scanned by the sensor unit 42.

Next, the processor 20 turns one LED on, and acquires the detection values from the sensor (step S105). More specifically, with one of LED 42*d* and LED 42*c* on, the processor 20 scans the evaluation area with the area image sensor 42*b*, and acquires gradation values indicating the brightness of each pixel in the evaluation area. By illuminating the print medium from one direction by one of the LEDs, shadows can be easily produced if there is any cockling of the print medium. Scanning the print medium by the sensor in this way makes cockling detection easier. The processor 20 functions as a data acquirer when acquiring the sensor detection values in step S105.

Figure 4:
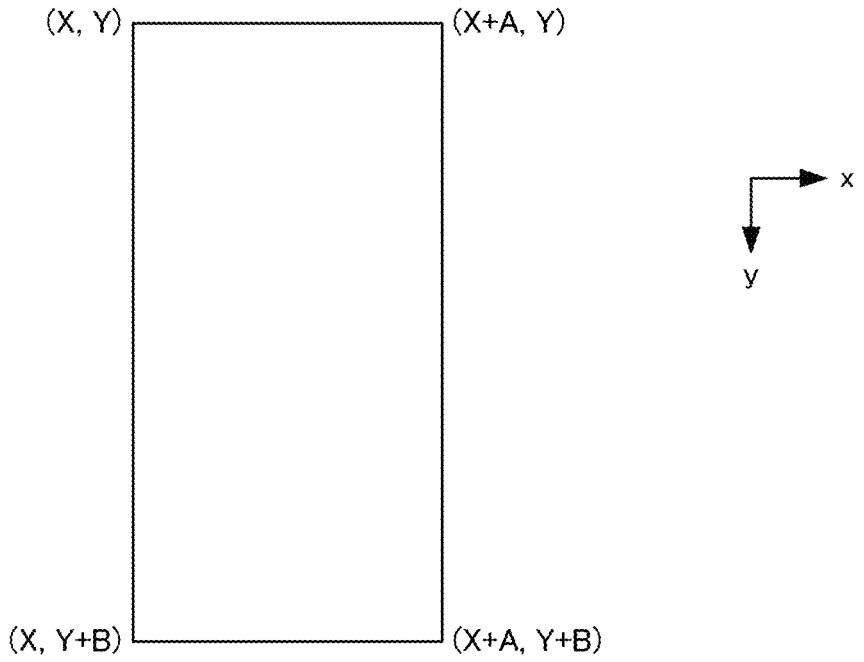
FIG. 4 illustrates a detection area.

The processor 20 then calculates the reflectivity (step S110). FIG. 4 shows an example of an evaluation area. If the coordinates of the four corners of an evaluation area that is long on the Y-axis are (X, Y), (X+A, Y), (X, Y+B), (X+A, Y+B), the reflectivity r is calculated based on the result of averaging the gradation values on the X-axis at each of the positions on the Y-axis of the evaluation area.

More specifically, the average of the gradation values (the gradation values output from the sensor unit 42) (X, Y+P) to (X+A, Y+P) at positions Y+P (where ($0 \leq P \leq B$)) on the Y-axis of the evaluation area is calculated, and the reflectivity r of the evaluation area averaged at each position on the Y-axis is calculated by substituting the average for S in equation (3) above. This enables knowing the general trend of reflectivity on the Y-axis of the evaluation area. Note that the mode or median, for example, may be used instead of the average.

Note that the average reflectivity r of Y-axis gradation values at each position on the X-axis of the evaluation area may also be calculated in step S110. More specifically, the average of the gradation values (X+Q, Y) to (X+Q, Y+B) at positions X+Q (where ($0 \leq Q \leq A$)) on the X-axis of the evaluation area is calculated, and the average Y-axis reflectivity r at each position on the X-axis of the evaluation area is calculated by substituting the average for S in equation (3) above.

The processor 20 then determines if the reflectivity is less than or equal to a threshold (step S115). This threshold is the lower limit of a specific range including the detection value (reflectivity in this example) used as the white reference of the print medium. As described above, the reflectivity r of the white reference is considered 100%. A reflectivity of 80%, for example, may be used as the lower limit (threshold) of the range of detection values treated as the white reference.

The processor 20 then compares the reflectivity r calculated in step S110 at positions on the Y-axis of the evaluation area with the threshold, and determines there is cockling if the reflectivity r at least one place on the Y-axis is less than or equal to the threshold. Note that lower reflectivity values indicate greater darkness. If reflectivity is less than or equal to the threshold, the processor 20 determines the reflectivity is dark compared with the reflectivity of the specific range including the reflectivity of the white reference, that is, detects a shadow and determines there is cockling. If the reflectivity exceeds the threshold, the processor 20 determines there is no cockling.

The processor 20 may also determine there is cockling if the reflectivity r is less than or equal to the threshold at any position on the X-axis.

This embodiment is configured to use the lower limit of a specific range including the detection value used as the white reference as the threshold for determining there is cockling if a detection value from the sensor is less than or equal to the threshold, but may also be configured to determine there is cockling if a sensor detection value exceeds the upper limit of the specific range.

More specifically, configurations that determine there is cockling if the sensor detection value is outside a specific range, and determine there is no cockling if the sensor detection value is inside the specific range.

When reflectivity is determined to be less than or equal to the threshold in step S115, the processor 20 stores in RAM the decision that there is cockling (step S120). For example, the processor 20 stores there is cockling on the print medium P relationally to the position where cockling was detected in the main scanning direction of the evaluation area.

Note that detection of cockling may be stored without storing the location of the evaluation area. If in step S115 the reflectivity is not less than or equal to the threshold, the processor 20 stores in RAM that cockling was not detected (step S125). For example, the processor 20 may store there is cockling on the print medium P relationally to a location in the main scanning direction of the evaluation area.

The processor 20 functions as an evaluator when executing steps S115-S125. Step S125 may also be omitted.

After step S120 or step S125, the processor 20 determines whether or not cockling detection was completed in all evaluation areas (step S130). In this example, multiple evaluation areas are set in the main scanning direction of the print medium P, and the presence of cockling is determined in each evaluation area. This reduces the possibility of failing to detect cockling. The evaluation areas may also be set based on locations in the main scanning direction where cockling is expected to easily occur. More specifically, evaluation areas may be set to positions between multiple conveyance rollers disposed to the same position in the sub-scanning direction, or based on the locations of recesses and protrusions on the platen.

If it is not determined in step S130 that cockling detection was completed in all evaluation areas, the processor 20 returns to step S100.

If it is determined in step S130 that cockling detection was completed in all evaluation areas, the processor 20 reports the results of cockling detection to the user (step S135). The processor 20 may report the cockling detection results by presenting the detection results stored in step S120 or step S125 on a display unit of the printer 10 not shown. If detection of cockling is reported, the user can take action to eliminate cockling, such as by smoothing the print medium P, before printing.

The processor 20 then ends the cockling detection process shown in FIG. 3 after step S135.

The cockling detection process may be executed on a single roll of roll paper at multiple locations in the sub-scanning direction. For example, after printing in a desired print area, the cockling detection process in FIG. 3 may be executed after advancing the roll paper for printing to the next print area and before starting to print to the next print area.

This embodiment of the invention can therefore determine whether or not there is any cockling without printing a cockling detection pattern in the evaluation area of the print medium P.

(1-4) Evaluation Examples

Figure 5:
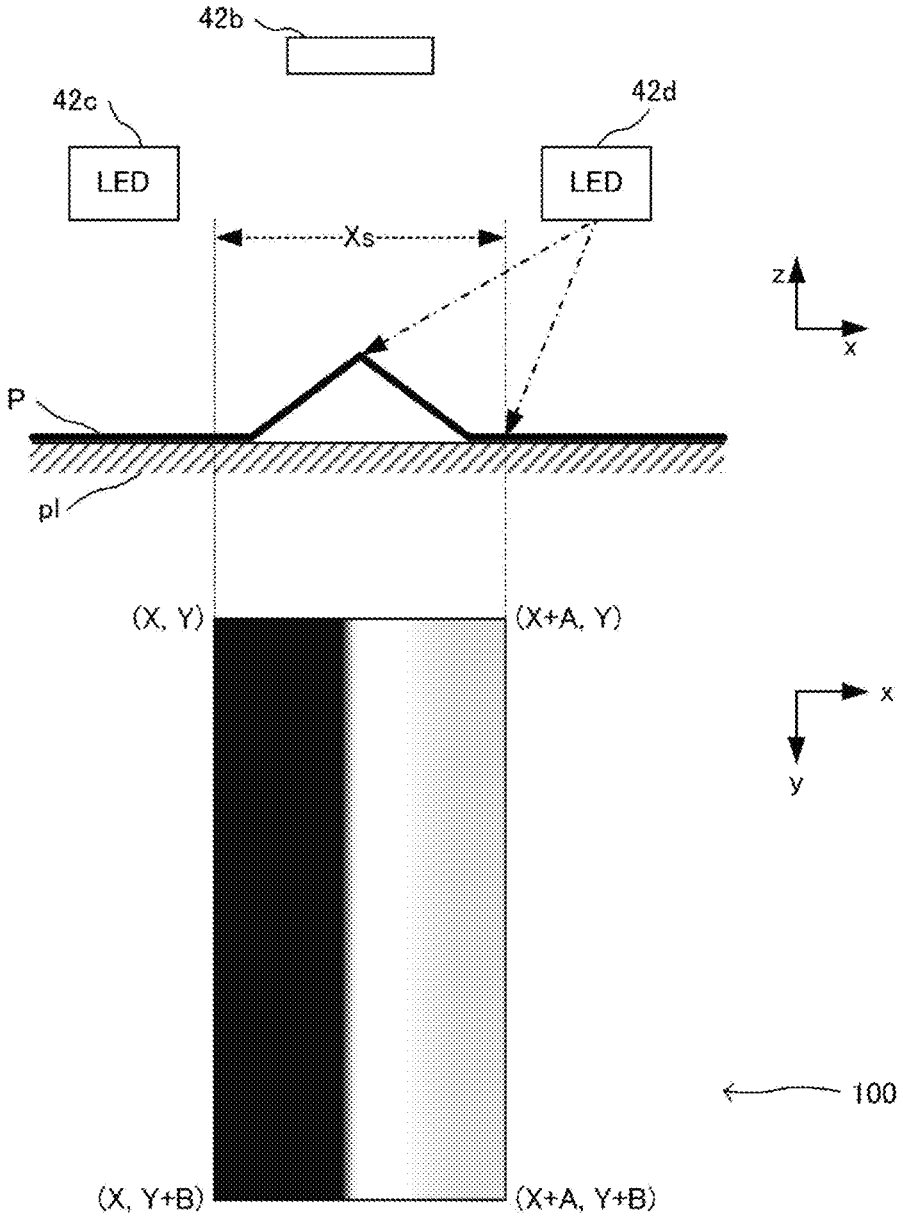
FIG. 5 shows an example of cockling.

FIG. 5 shows an example of cockling and the scanned image thereof. In this example the peak of a wrinkle in the print medium P extends parallel to the Y-axis. In addition, the image 100 in FIG. 5 schematically illustrates the brightness of the image of the evaluation area captured by the area image sensor 42*b* when the print medium P is illuminated by LED 42*d*. The image becomes lighter with proximity to white, and darker with proximity to black. As shown in FIG. 5, the side of the peak of the wrinkled in the print medium P facing the LED 42*d* is brighter, and the opposite side is dark.

Figure 6:
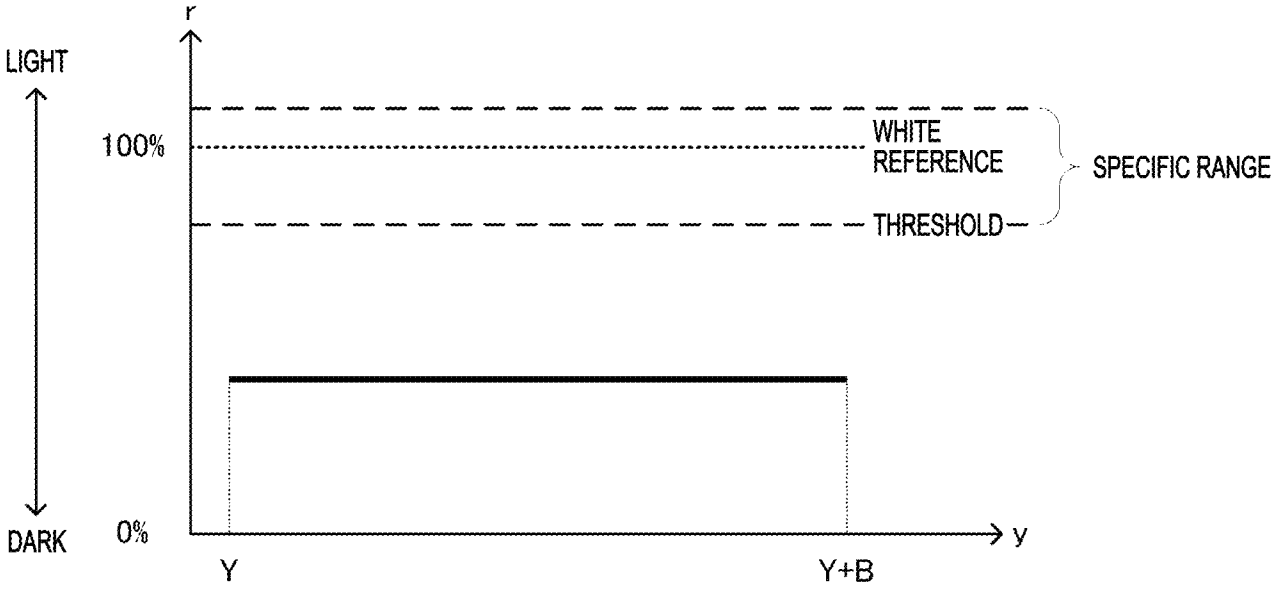
FIG. 6 is a graph of reflectivity.

FIG. 6 is a graph of reflectivity r (reflectivity averaged in along the X-axis) at positions along the Y-axis of the image 100 in FIG. 5. When the print medium P is wrinkled with the peak of a wrinkle at substantially the same height across the Y-axis of the evaluation area extending parallel to the Y-axis as shown in FIG. 5, there is substantially constant reflectivity r across the Y-axis of the evaluation area as indicated by the bold solid line in the graph in FIG. 6. When reflectivity r is darker than the threshold as shown in FIG. 6, the processor 20 can determine there is cockling in the evaluation area.

(2) Other Embodiments

The invention is described with reference to desirable embodiments above, but the invention is not so limited and can be varied in many ways. For example, the image processing device of the invention can be applied to devices other than printers, such as scanners, and may be used in devices having functions other than a printer function.

The printer may use printing methods other than inkjet printing, including electrophotographic printing methods.

In addition, the method of detecting cockling in the evaluation area based on change in the detection values of sensors in the evaluation area of the print medium can also be expressed as a cockling detection method executed by a computer, and an image processing program.

In addition, functions described in the accompanying claims may be embodied by hardware resources having functions defined by the hardware configuration, hardware resources having functions defined by a program, or combinations thereof.

The functions of these elements are also not limited to embodiments of physically discrete hardware resources.

The foregoing embodiments are also simply examples, elements of the configurations may be omitted, other configurations may be added, and other elements or configurations having the same effect may be substituted.

For example, the sensor unit of the invention may be configured with N (where N is an integer of two or more) light sources that illuminate the evaluation area from mutually different positions, and the controller controls N or fewer light sources of the N light sources to turn on one at a time to scan the print medium with the sensors and detect cockling.

More specifically, configurations that scan the print medium by turning ON at least two or more of N light sources one by one, and determine whether or not there is cockling based on the scanning results (the detection values of the sensors) are also conceivable. This configuration can detect cockling in multiple directions.

Note that all light sources of the N light sources of the sensor unit do not necessarily need to be used to detect cockling.

In the first embodiment, the sensor unit 42 is configured with two LEDs that illuminate the evaluation area from opposing positions along the main scanning direction with the evaluation area between the LEDs, and the sensor unit 42 reads an image of the print medium with only one of the LEDs on during cockling detection. However, in addition to the above two LEDs, the sensor unit 42 may also be configured with a third LED that is located at a position offset on the Y-axis from a line parallel to the Z-axis and passing through the center of the evaluation area.

Further alternatively, the sensor unit 42 may be configured with two LEDs that are disposed to positions on the Y-axis symmetrically to a line that is parallel to the Z-axis and passes through the center of the area image sensor 42*b*, and are oriented to enable illuminating the same area (evaluation area) from those symmetrical positions.

Further alternatively, the sensor unit 42 may be configured with two LEDs including one LED that illuminates the evaluation area from a position offset on the X-axis from a line that is parallel to the Z-axis and passes through the center of the evaluation area, and one LED that illuminates the evaluation area from a position offset on the Y-axis from a line that is parallel to the Z-axis and passes through the center of the evaluation area.

The sensor unit 42 may also be configured with only one LED. If illuminating the evaluation area from a direction enabling easily detecting cockling (easily producing shadows) in the direction with the greatest chance of cockling occurring is sufficient, the sensor unit may be configured with only one LED.

Yet further alternatively, the sensor unit 42 may be configured so an LED illuminates the evaluation area from a position that is offset on the X-axis and offset on the Y-axis from a line parallel to the Z-axis and passing through the center of the evaluation area.

The controller may also be configured in other ways as long as the presence of cockling can be determined based on change in the detection values of a sensor in an evaluation area of a print medium illuminated by a light source. The first embodiment described above is configured to determine there is cockling when the sensor detection values change from a detection value expected when there is no cockling of the print medium, but may be configured to evaluate cockling by other methods. For example, configurations that detect cockling when the change in sensor detection values from the evaluation area is more abrupt than a specific reference are conceivable.

Figure 7:
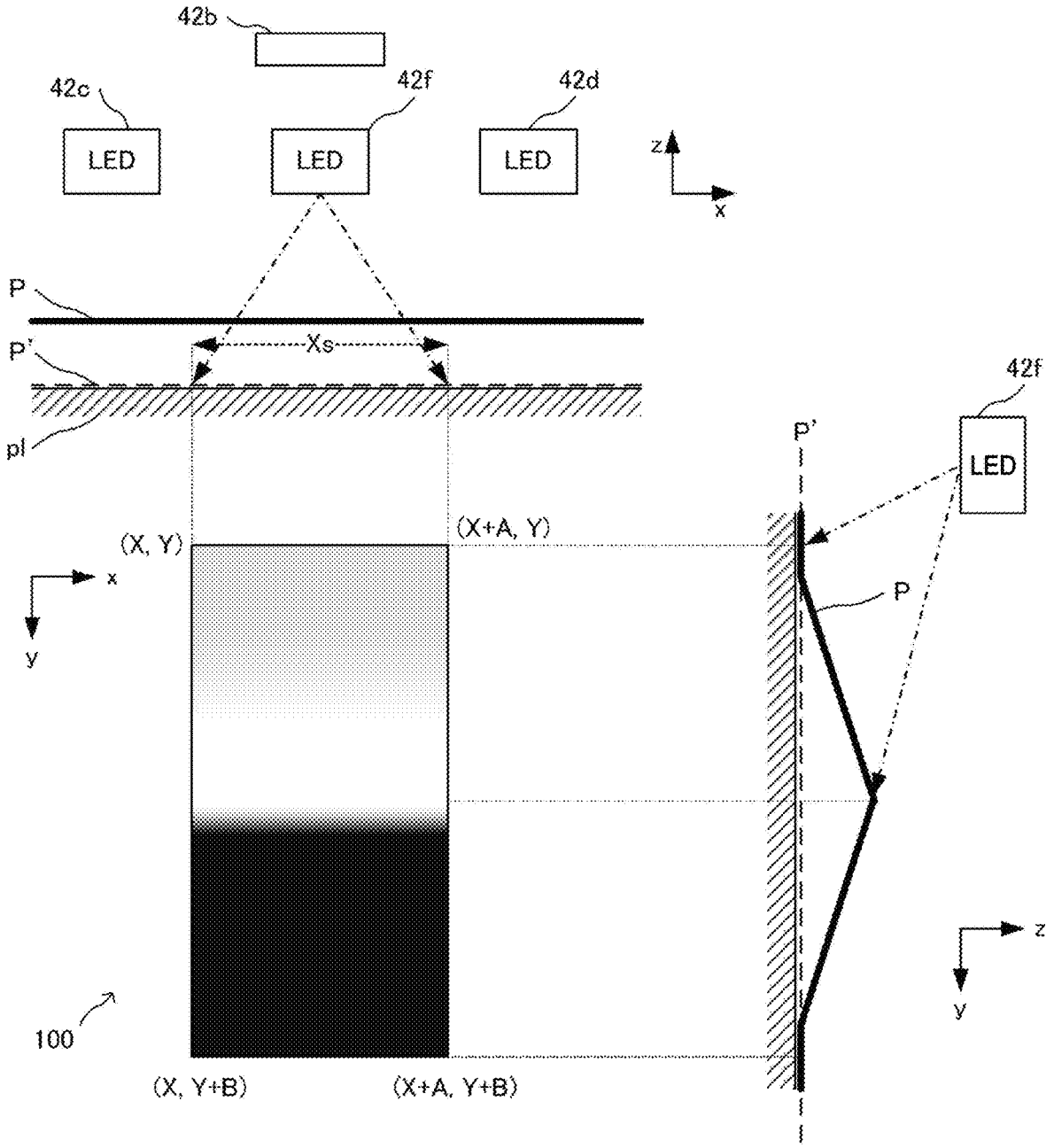
FIG. 7 shows another example of cockling.

FIG. 7 describes an example of this configuration. In this example the sensor unit 42 has three LEDs, LEDs 42*c*, 42*d*, 42*f*. LEDs 42*c* and 42*d* are the same as in the first embodiment. LED 42*f* is disposed inside the case 42*a* of the sensor unit 42. LED 42*f* is also located at and illuminates the evaluation area from a position offset on the Y-axis from a line that is parallel to the Z-axis and passes through the center of the evaluation area. The processor 20 scans the evaluation area of the print medium P when only the LED 42*f* is on, and evaluates cockling based on the scanning result.

FIG. 7 illustrates the presence of cockling of the print medium P with wrinkles in the sub-scanning direction. More specifically, a line connecting the peaks of the cockling wrinkles in the print medium P extends in the main scanning direction, and the peaks are closer to the area image sensor 42*b* than position P' on the Z-axis when there are no wrinkles in the print medium P.

Figure 8:
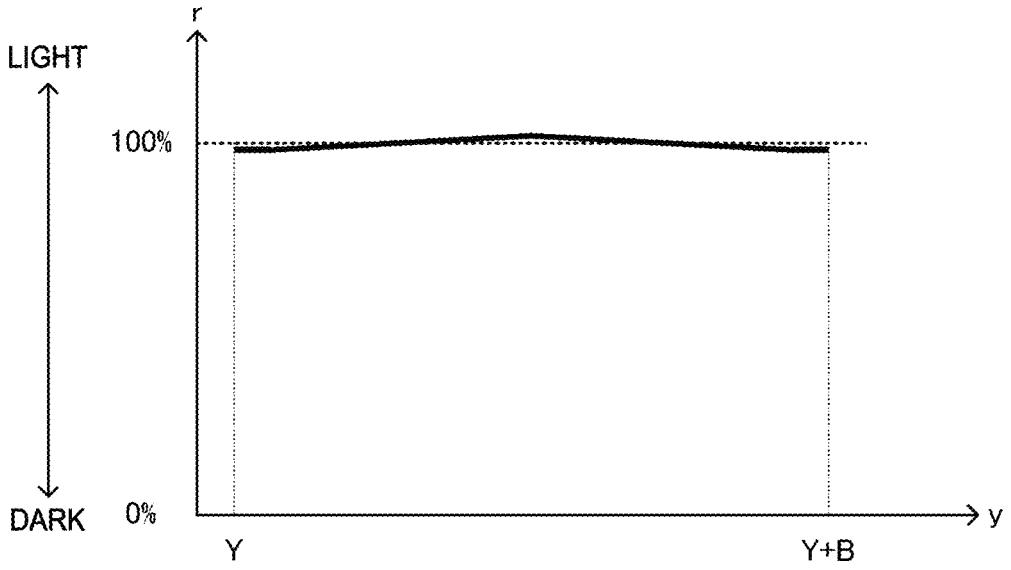
FIG. 8 is a graph of reflectivity.

When cockling occurs in this way, if the evaluation area is scanned with LED 42*d* on and other LEDs (LED 42*c* and LED 42*f*) off (not illustrated in FIG. 7), and reflectivity averaged on the X-axis for each position on the Y-axis is calculated (for locations Y+P (0≤P≤B) along the Y-axis of the evaluation area, the average of gradation values (X, Y+P) to (X+A, Y+P) is calculated, and reflectivity r is calculated from the average), reflectivity r averaged for locations on the Y-axis as indicated by the solid bold line in the graph in FIG. 8 is substantially constant although brightness rises slightly toward the peak.

However, if the evaluation area is scanned with LED 42*f* on and the other LEDs (LED 42*c* and LED 42*d*) off (see FIG. 7), the LED 42*f* side of the peaks of the wrinkles in the print medium P is bright, and the opposite side of the peaks is dark, as shown in image 100 in FIG. 7. The reflectivity r averaged across each position on the Y-axis of the evaluation area changes abruptly near the peaks of the wrinkles in the print medium P as indicated by the solid bold line in the graph in FIG. 8. Cockling can therefore be evaluated based on the degree of change in the reflectivity r when the reflectivity r changes abruptly in the evaluation area. For example, if the change in reflectivity r per unit distance along the Y-axis is greater than a predetermined reference amount, the controller may determine there is cockling.

Figure 9:
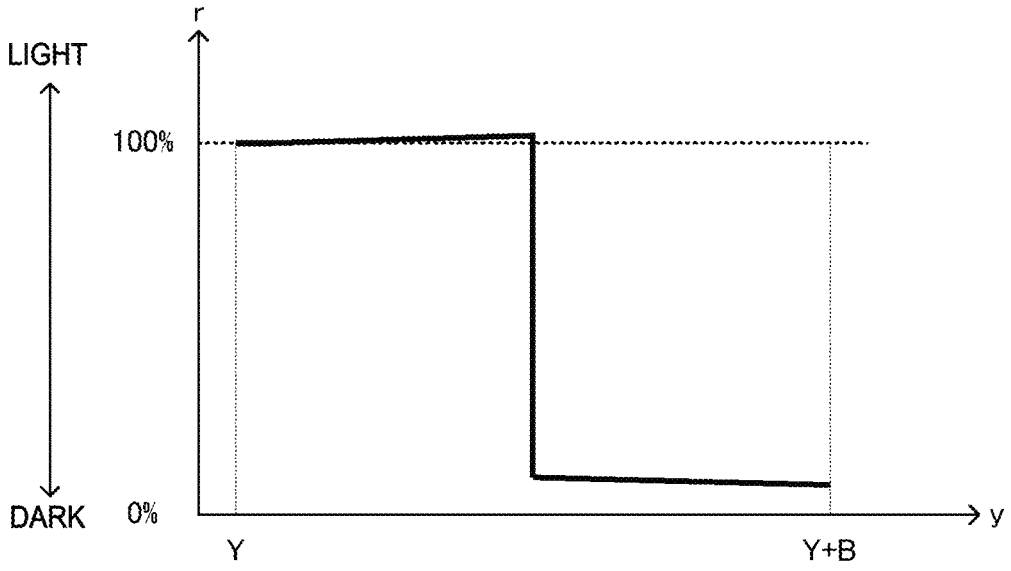
FIG. 9 is a graph of reflectivity.

Note that cockling can also be detected according to the cockling detection standard described in the first embodiment when reflectivity r changes on the Y-axis as shown in FIG. 9. More specifically, because the reflectivity r from where reflectivity r changes abruptly to Y+B is outside the specific range including the white reference in FIG. 9, the controller can determine cockling has occurred.

Because cockling can occur for many reasons, the direction of the cockling (the direction along the peaks or valleys of the wrinkles in the print medium) may also extend in many directions. However, if the direction in which cockling frequently occurs is known, being able to efficiently evaluate cockling in the direction of frequent occurrence (such as by minimal processing) is desirable.

Suppose, for example, that cockling with the direction along the peaks of the wrinkles in the print medium parallel or substantially parallel to the Y-axis occurs more frequently than cockling with the direction along the peaks of the wrinkles parallel to the X-axis.

If the cockling of greater frequency is cockling with the direction between the peaks parallel to the Y-axis as shown in FIG. 5, for example, scanning results such as shown in image 100 in FIG. 5 are acquired. When scanning results such as shown in image 100 in FIG. 5 are acquired, reflectivity r averaged along the X-axis at each position on the Y-axis will be substantially flat as shown in FIG. 6, but reflectivity r averaged along the Y-axis at each position on the X-axis in the image 100 shown in FIG. 5 changes abruptly at a position on the X-axis near the peaks (not shown in the figure).

Therefore, if it is known that cockling with the direction between the peaks parallel or substantially parallel to the Y-axis occurs more frequently than cockling with the direction between the peaks parallel or substantially parallel to the X-axis, reflectivity r averaged along the Y-axis at each location in the evaluation area on the X-axis may be calculated, and cockling may be detected based on whether or not there is a location where reflectivity r changes abruptly and exceeds a predetermined threshold level.

Note that when cockling occurs frequently in a particular direction, the light source is obviously configured to illuminate the evaluation area from the direction in which shadows are easily produced by the cockling (that is, a direction not parallel to the direction in which the peaks or valleys extend).

Note that if there is no location in the evaluation area where reflectivity r calculated based on the average gradation values along the Y-axis at each position on the X-axis changes abruptly and equals or exceeds a predetermined threshold, reflectivity r may be recalculated based on the average gradation values along the X-axis at each position on the Y-axis, and cockling detected based on whether or not there is a location where the reflectivity r changes abruptly and equals or exceeds a predetermined threshold.

The invention may therefore be configured to calculate brightness averaging gradation values in a first direction at positions along a second direction that is perpendicular to the first direction, which is the expected direction along the peaks or valleys of wrinkles in a print medium caused by cockling, and determine there is cockling when the brightness changes abruptly by more than a predetermined reference level in the second direction.

An example of a configuration that evaluates cockling by another method is a configuration that determines there is cockling when, for example, sensor detection values in the evaluation area drop from a first range to a second range, and then return to the first range. More specifically, when there is a dark area in the evaluation area between a bright area and another bright area, it can be decided that there is cockling (cockling with valleys and peaks) in the evaluation area of the print medium.

Figure 10:
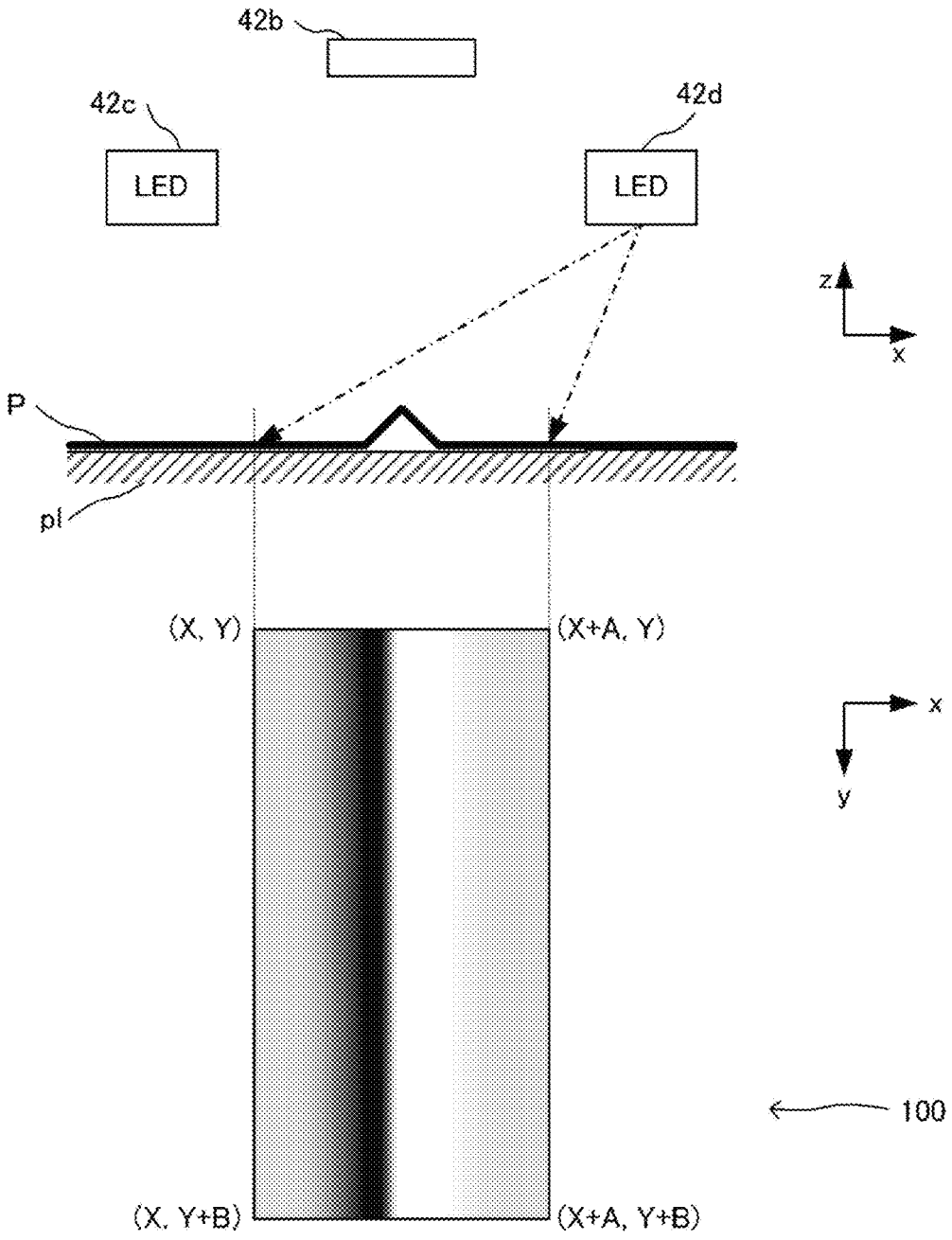
FIG. 10 shows another example of cockling.

FIG. 10 shows an example in which the print medium P is wrinkled in the evaluation area with the peaks extending parallel to the sub-scanning direction, and light from the light source reaches, without being blocked by the peaks, at least the end part (end part in the main scanning direction) of the evaluation area on the side farther from the light source than the peaks.

When the evaluation area is scanned with LED 42*d* on and LED 42*c* off as shown in FIG. 10, a scanning image having a dark area between light areas is acquired as shown in image 100 in FIG. 10.

Figure 11:
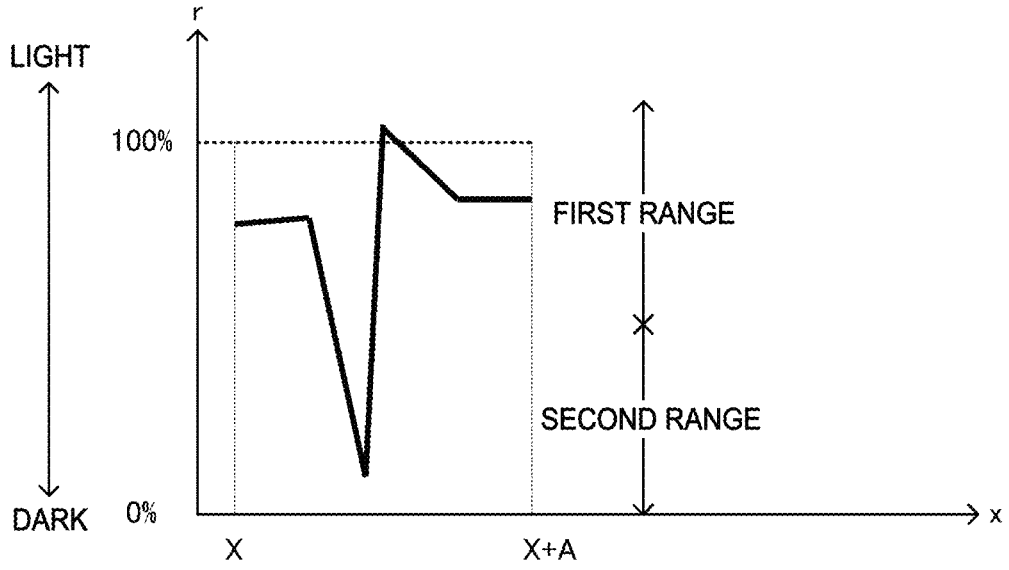
FIG. 11 is a graph of reflectivity.

FIG. 11 is a graph of the reflectivity r (reflectivity averaged along the Y-axis) at positions along the X-axis. As shown in FIG. 11, when the reflectivity in the evaluation area drops from a first range to a second range, and then returns to the first range, cockling can be determined to be present in the evaluation area of the print medium P.

Figure 12:
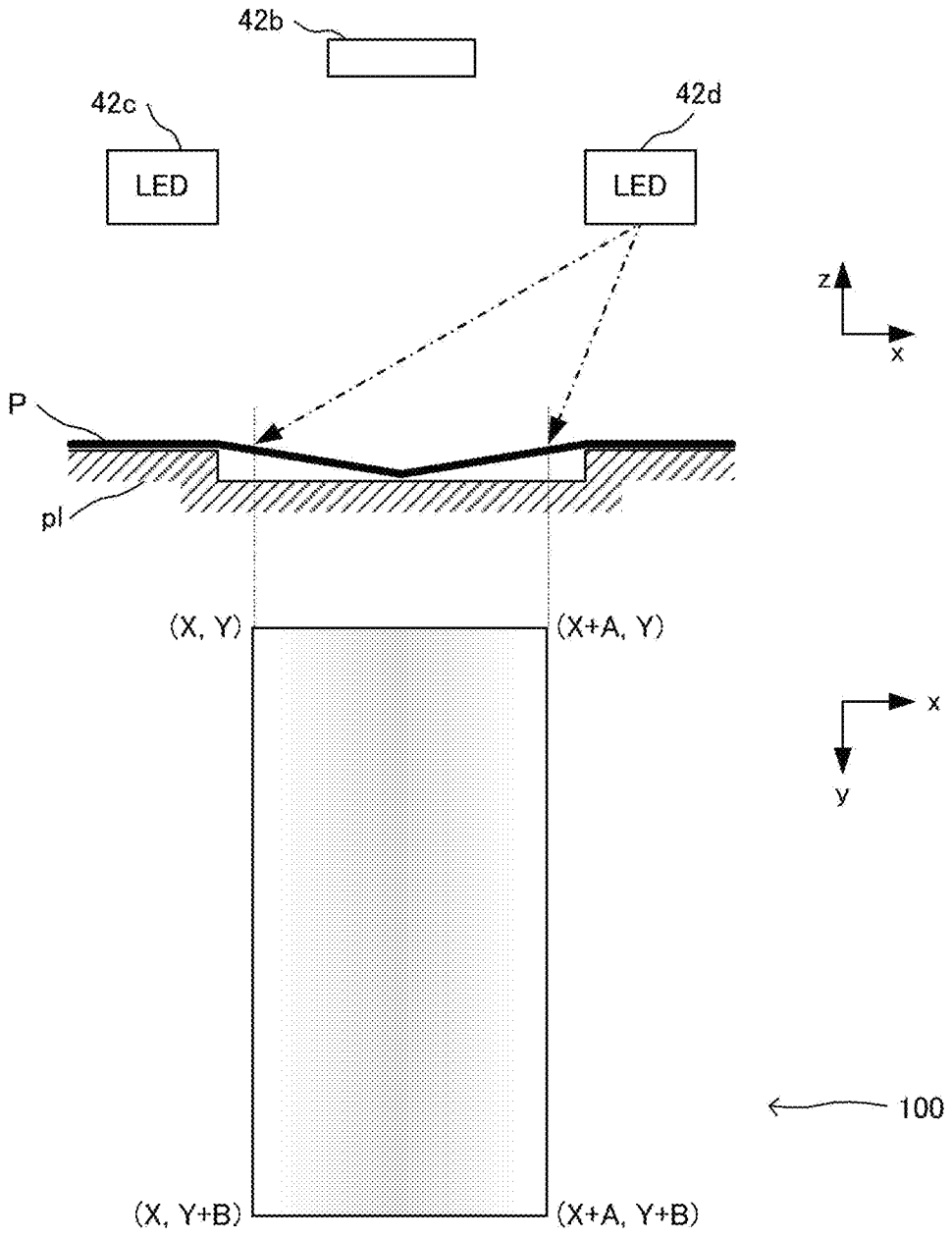
FIG. 12 shows another example of cockling.

FIG. 12 shows an example of a platen pl having a recess at a position in the evaluation area, and the print medium P forming a valley along the channel. This example supposes that the bottom of the valley extends parallel to the sub-scanning direction. As shown in FIG. 12, when the evaluation area is scanned with LED 42*d* on, an image with bands along the edges that are slightly brighter than the middle in the main scanning direction is acquired.

Figure 13:
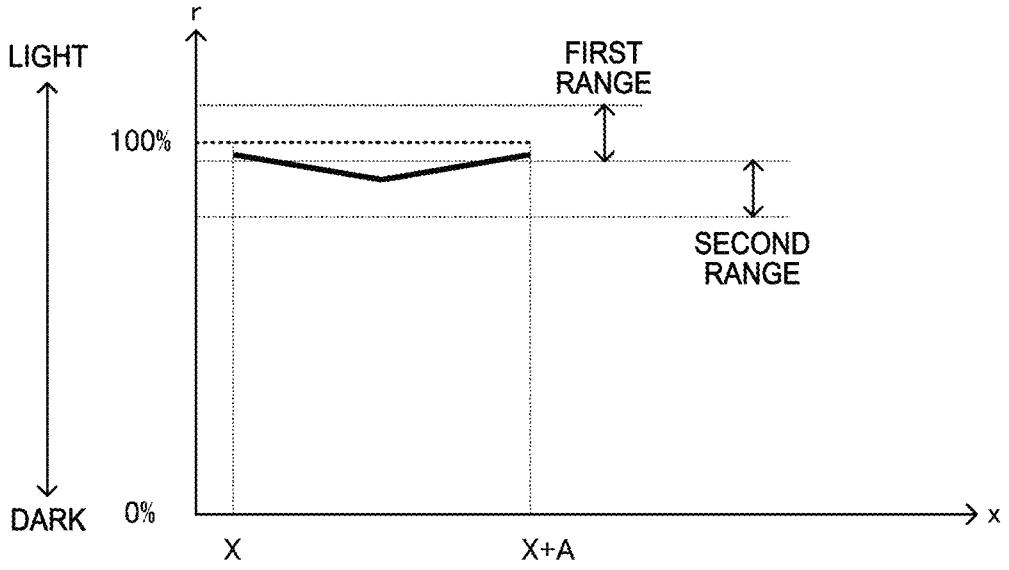
FIG. 13 is a graph of reflectivity.

FIG. 13 is a graph showing the reflectivity r (reflectivity averaged along the Y-axis) at positions along the X-axis. As shown in FIG. 13, when the reflectivity in the evaluation area drops from a first range to a second range, and then returns to the first range, cockling can be determined to be present in the evaluation area of the print medium P.

Various other configurations that determine whether or not there is cockling in the evaluation area based on change in sensor detection values in the evaluation area of the print medium are also conceivable.

For example, the sensor detection values used for cockling detection may be reflectivity or gradation values. Cockling may also be evaluated using red, green, and blue colors, or using any one color, or based on the brightness of pixels calculated from red, green, and blue gradation values. When cockling is detected, control that changes the ink ejection timing where cockling is detected may also be applied.

The sensor may also be configured in any way enabling scanning the print medium. More specifically, configurations that enable detecting cockling based on scanning results from an area of the print medium (evaluation area) scanned by the sensor are conceivable. The sensor may therefore capable of moving as described in the examples above, or configured to scan multiple evaluation areas by multiple sensors. Various configurations can also be used as configurations for moving the sensor, and configurations other than configurations carrying the sensor on the carriage of the printing mechanism can also be used.

The sensor can also be configured in many ways, including configurations other than configurations having an area image sensor. For example, a line sensor may be used, and in this case may be configured to scan the evaluation area by relative movement between the sensor and the print medium.

The print medium may be any medium that is brightest when no recording material (ink or toner, for example) has been recorded, and which becomes darker as the density of the recording material (equivalent to the amount of recording material placed on the print medium) increases, and may be media other than printing paper. The color of the print medium is also not limited to white, and may be transparent or other color (however, in this case the condition of the print medium when no recording material has been recorded is used as the white reference).

The light source may be any means of illuminating the print medium. More specifically, the light source may be any configuration capable of illuminating the area scanned by the sensor (evaluation area). The light source may therefore be configured to move as described in the above examples, or affixed to a housing of the image processing device, for example.

The light source may also emit any light of which the reflection from the print medium can be read by the sensor, and the light emitted by the light source may be white light or other color of light.

Cockling refers to the print medium being deformed with wrinkles for some reason. When the direction of the cockling is defined as the direction in which the peaks or valleys of the wrinkles in the print medium extend, the direction in which the peaks or valleys extend may travel in many ways, and is not necessarily parallel to or perpendicular to the conveyance direction of the print medium.

The direction in which the peaks or valleys extend is also not necessary a single straight light, and may be a curved line or curves.

The height of the peaks in the cockling is also not limited to a constant difference from the height of the print medium where there is no cockling. The peaks or valleys of the cockling may also be curved surfaces.

The evaluation area of the print medium evaluated for cockling may also be a blank (unprinted) area or a printed area.

The controller may be any configuration capable of controlling the light source and sensor. More specifically, the controller may be any configuration able to scan the print medium with the sensor when the print medium is illuminated by the light source emitting light to the print medium.

In addition, the controller may be any configuration enabling determining whether or not there is cockling in the evaluation area based on change in the sensor detection values acquired from the evaluation area of the print medium. Change in the detection values of the sensor express change in brightness (light and dark) caused by cockling. More specifically, when a print medium with cockling is illuminated by the light source, light and dark areas are caused by the cockling. More specifically, part of the cockling area is bright when illuminated by the light source, and another part is made dark by illumination from the light source. The controller is a configuration that can identify light and dark areas made evident by the light source exposing the cockling to light as changes in the detection values from the sensor.

Another aspect of the invention may use a configuration that acquires cockling evaluation results using a neural network model optimized by machine learning using training data correlating images acquired by the sensor unit 42 scanning the evaluation area of the print medium P to the presence or absence (1: present; 0: absent) of cockling in the image.

Figure 14:
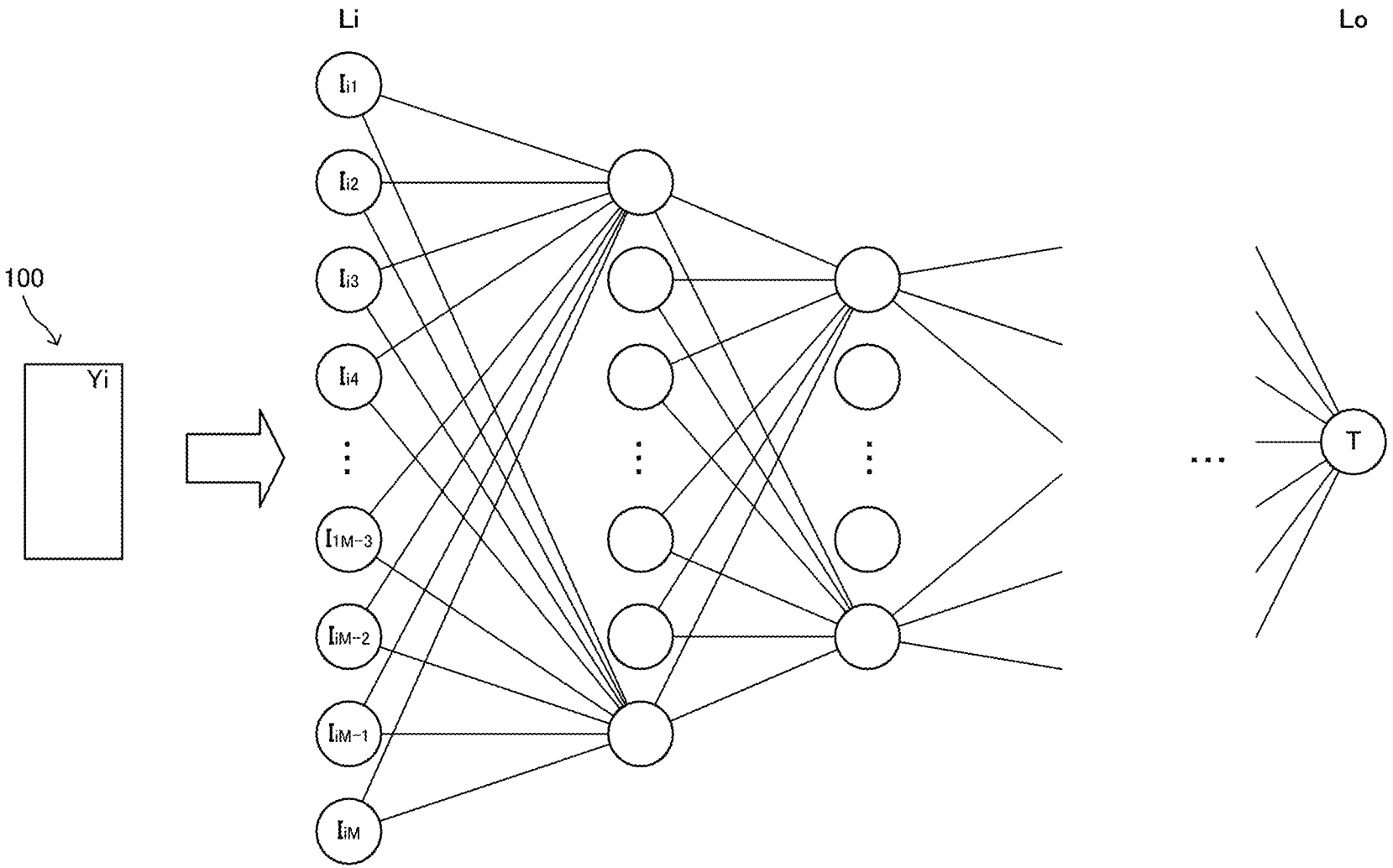
FIG. 14 shows an example of a learning model.

FIG. 14 shows an example of input data input to the input layer Li of the model and output data output to the output layer Lo. In this example, gradation values indicating the luminance of pixels in the image 100 acquired by the sensor unit 42 scanning the evaluation area of the print medium P are input to the input layer Li; and cockling presence data (whether or not the image 100 is the image of an evaluation area where cockling was detected) is output to the output layer Lo. The pixel values input to the input layer Li may be gradation values for any one channel of the three RGB channels, or gradation values for all color channels.

Various elements may be appropriately selected for machine learning by the neural network, including: the number of layers and number of nodes in the model; the type of activation function; the type of loss function; the type of gradient descent; the type of gradient descent optimization algorithm; the type of mini-batch and number of batches; learning rate; initial values; type of overfitting prevention method and if overfitting prevention is used; whether there is a convolution layer; size of filter for convolution; type of filter; type of padding and stride; type and presence of pooling layer; presence of a fully connected layer; and the presence of a recursive structure. Other types of machine learning can obviously also be used, including a support vector machine, clustering, and reinforcement learning.

Machine learning that automatically optimizes the structure of the model (such as the number of layers and number nodes per layer) may also be used.

A machine learning process, and a cockling evaluation process optimized by a machine learning process, may be run by the processor 20 of the printer 10, or by an external information processing device communicatively connected to the printer 10. When the machine learning process is executed by the processor 20 or an external information processing device, these devices are examples of a machine learning system, and the processor 20 and the CPU of the information processing device function as an acquirer and trainer.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An image processing device comprising:

a light source configured to illuminate a print medium;

a sensor configured to scan a cockling evaluation area in the print medium illuminated by the light source; and a controller configured to control the light source and sensor;

the controller determining if there is cockling based on change in a detection value that is either a gradation value read by the sensor in the evaluation area, or reflectivity acquired by converting the gradation value, wherein change in the detection value is change from a detection value expected when there is no cockling on the print medium, a minimum limit of a specific range including a detection value used as a white reference of the print medium is a threshold, and the controller determines there is cockling when the detection value is less than or equal to the threshold.

2. The image processing device described in claim 1, wherein:

the detection value used as a white reference of the print medium is a detection value read by the sensor from an area of the print medium that is unprinted and has no cockling.

3. The image processing device described in claim 1, wherein:

the detection value used as a white reference of the print medium is a detection value acquired when multiple light sources are on.

4. The image processing device described in claim 1, wherein:

the controller determines there is cockling when change in the detection value in the evaluation area is abrupt and greater than a reference.

5. The image processing device described in claim 1, wherein:

the controller determines there is cockling when the detection value in the evaluation area drops from a first range to a second range, and then returns to the first range.

6. The image processing device described in claim 1, wherein:

the controller controls the sensor to scan the print medium when one light source is on.

7. The image processing device described in claim 1, wherein:

there are N (where N is an integer of two or more) light sources configured to illuminate the evaluation area from mutually different positions; and the controller causes N light sources or fewer of the N light sources to emit one at a time while the sensor scans the print medium, and determines if cockling is present.

8. The image processing device described in claim 1, wherein:

at least two of the multiple light sources are disposed to opposing positions.

9. The image processing device described in claim 1, wherein:

the controller determines if cockling is present in each of multiple evaluation areas in a main scanning direction of the print medium.

10. A cockling detection method comprising:

acquiring a detection value of a sensor that scans a print medium illuminated by a light source; and determining if there is cockling in an evaluation area of a print medium based on change in a detection value that is either a gradation value read by the sensor in the evaluation area, or reflectivity acquired by converting the gradation value, wherein change in the detection value is change from a detection value expected when there is no cockling on the print medium, a minimum limit of a specific range including a detection value used as a white reference of the print medium is a threshold, and there is cockling when the detection value is less than or equal to the threshold.

* * * * *